United States Patent [19]

Kohler

[11] Patent Number: 4,877,158

[45] Date of Patent: Oct. 31, 1989

[54] FLUID DISPENSING APPARATUS

[76] Inventor: Tilmann L. Kohler, 31 Blossom Waye, Heston, Middlesex TW5 9HB, United Kingdom

[21] Appl. No.: 180,400

[22] Filed: Apr. 12, 1988

[51] Int. Cl.[4] ..... B65D 83/14; B05B 11/06

[52] U.S. Cl. ..... 222/400.8; 222/153; 222/383; 222/402; 239/337; 239/339; 239/373

[58] Field of Search ..... 222/399, 400.5, 401, 222/402, 400.7, 400.8, 153, 383; 239/337, 339, 373; 403/342; 285/272, 278, 280, 281

[56] References Cited

U.S. PATENT DOCUMENTS

| | | | |
|---|---|---|---|
| 1,305,754 | 6/1919 | Tate et al. | 222/399 |
| 1,616,077 | 2/1927 | Curtis | 222/401 |
| 1,968,316 | 7/1934 | Schmitt | 222/401 |
| 2,060,512 | 11/1936 | Magill . | |
| 3,386,664 | 6/1968 | Knibb . | |
| 4,369,899 | 1/1983 | Magers et al. | 222/153 |
| 4,436,227 | 3/1984 | Johnson, Jr. et al. | 222/400.8 |
| 4,479,589 | 10/1984 | Ford | 222/153 |
| 4,520,954 | 6/1985 | Brown | 222/400.8 |
| 4,537,334 | 8/1985 | Spengler et al. | 222/401 |
| 4,711,377 | 12/1987 | Brown | 222/401 |
| 4,785,973 | 11/1988 | Kobe | 222/400.7 |

*Primary Examiner*—Andres Kashnikow
*Assistant Examiner*—Christopher G. Trainor
*Attorney, Agent, or Firm*—Marmorek, Guttman & Rubenstein

[57] ABSTRACT

The fluid dispensing apparatus includes a body portion supporting a pump assembly and a valve assembly. A fastening ring has an internal screw-thread for screw-threadedly engaging the neck of a container. A fastening ring retaining member allows the ring to rotate freely with respect to the body portion but also has a central opening for accommodating a fastening member which acts both to lock the member to the body portion and to couple with an outlet duct in the body portion leading to the valve assembly. In addition the member defines a separate passage which provides communication between the pump assembly and the interior of the container. The fastening member has a central opening for receiving a pipe which is arranged to extend to the bottom of the container.

12 Claims, 3 Drawing Sheets

FLUID DISPENSING APPARATUS

BACKGROUND OF THE INVENTION

1. Field of the Invention

The present invention relates to fluid dispensing apparatus.

2. Description of the Prior Art

U.S. Patent specification Nos. 2060512 (Magill) and 3386,664 (Knibb) disclose fluid dispensing apparatus in which there is provided a pump unit for pumping air into a sealed container to place the liquid in the container under pressure. The unit has a downwardly depending pipe which can be inserted through a small orifice in the top of the container to extend to the bottom of the container. The pipe at its upper end, terminates in a valve which when operated releases liquid forced up the pipe by the pressure in the container, through an outlet spout.

The downwardly depending pipe and another pipe (for forcing air into the container) from the unit pass into the container through a custom-made rubber bung or seal which is tightly fitted into the orifice. The pump unit is arranged to be clamped to the rim of the container to prevent relative movement between the pump unit and the bung so as to maintain the seal in tact.

This unit is only suitable for containers of a specific type.

It is an object of the invention to provide an improved fluid dispensing apparatus for mounting an externally screw-threaded opening of a container in place of the normal screw-threaded closure cap of the container.

SUMMARY OF THE INVENTION

According to the present invention there is provided apparatus for dispensing liquids comprising a body portion supporting a pump assembly for pumping air and a valve portion having an outlet duct housing a valve for opening and closing the duct, a locking member for locking on to an opening of a container, a locking member retainer rotatably supporting the locking member, and a fastening member defining a liquid flow passage, the fastening member being arranged to be fastened to the body member, to sealingly couple the liuqid flow passage to the outlet duct and to lock the locking member retainer to the body portion, the fastening member and the locking member retainer when locked to the body portion defining an uninterrupted fluid passage from the pump assembly which does not directly communicate with the liquid flow passage and sealing means located on the locking member retainer for enabling a seal to be effected between a container and the locking member retainer when the locking member retained by the locking member retainer is locked to the container.

According to the present invention there is further provided fluid dispensing apparatus comprising a body portion supporting a pump assembly and a valve assembly, a closure member having an internal screw-thread for screw-threadedly engaging a screw-threaded neck of a container, a retaining member for retaining the closure member on the body portion but which allows the closure member to rotate relative to the body portion, the retaining member having a central opening accommodating a fastening member which acts both to lock the member to the body portion and to couple with a duct in the body portion leading to the valve assembly, the retaining member also defining a separate passage which provides communication from the pump assembly to the container when the apparatus is secured thereto by the closure member.

BRIEF DESCRIPTION OF THE DRAWINGS

Fluid dispensing apparatus embodying the invention will now be described, by way of example, with reference to the accompanying diagrammatic drawings, in which.

DESCRIPTION OF THE PREFERRED EMBODIMENT

The fluid dispensing apparatus to be described is arranged to dispense discrete quantities of liquids from drums or containers 13.

Drums or containers for liquid chemicals are typically of plastics material and hold quantities of liquid both smaller and greater than 20 litres. Access to such containers is through a narrow cylindrical neck 11 upstanding from the roof of the container 13. The neck 11 is externally screw-threaded and is closed by an internally screw-threaded cap (not shown). The apparatus to be described is arranged to screw-threadedly engage with the neck 11 and to seal the container 13 in place of the cap.

The apparatus has a pump for forcing air under pressure into the container and a duct through which fluid can pass from the container to a manually operable outlet valve.

Figure 1:
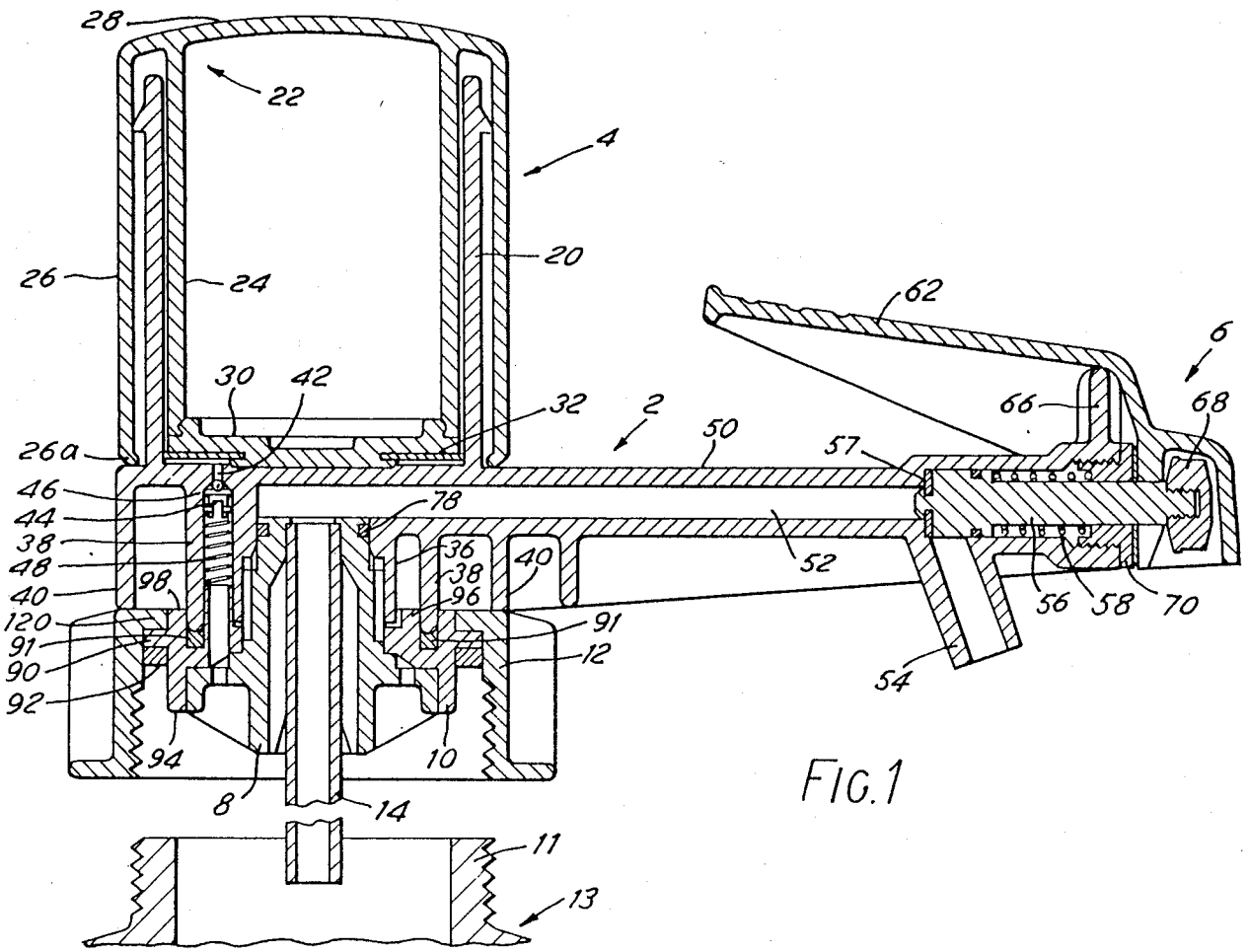
FIG. 1 is a section through the apparatus.

As shown in FIG. 1 the apparatus comprises a body portion 2 carrying a pump section 4 and a valve section 6. A boss or fastening member 8 is arranged to screw-threadedly engage the body portion 2 to imprison a locking ring retainer 10 and a locking ring 12 against the body portion 2. An elongate pipe 14 is push fitted into a central bore or opening in the fastening member 8.

The pump section 4 has a cylinder defined by a cylinder wall 20 upstanding from the body portion 2. The cylinder is engaged by a piston member 22 having concentric inner and outer spaced walls 24 and 26. The cylinder wall 20 is arranged to be accommodated in the annular space between the inner and outer walls 24 and 26 of the piston member 22. The piston member 22 has a roof 28 which closes the upper axial ends of the two walls 24 and 26.

The lower axial end of the inner wall 24 of the piston member 22 is closed by a piston base 30 carrying a disk-like piston seal 32 which is arranged to engage the inner face of the cylinder wall 20.

An interrupted annular flange projects outwardly from the outer surface of the cylinder wall 20 adjacent the upper end thereof; the interruptions in the flange allow the passage of air therepast. The lower end **26*a* of the outer wall 26 is turned inwardly. The arrangement is such that when the piston member 22 is raised to perform its return stroke the travel of the lower end 26*a*** is arrested when it engages the interrupted annular flange.

The annular flange is axially tapered, increasing in diameter with distance from the top of the cylinder wall, to enable the piston member 22 to be readily coupled to the cylinder during assembly.

The body portion 2 below the cylinder defines two coaxial walls, an inner wall 36 an an outer wall 38. The annular space between the two walls 36 and 38 is braced by a plurality of radially extending bracing ribs (not shown). The shape between the outer wall 38 and the outer wall 40 of the body portion is similarly braced by radially extending bracing ribs (not shown).

A through duct 42 in the body portion provides fluid communication between the base of the cylinder and the annular space between the two walls 36 and 38. A spring biassed non-return valve 44 is accommodated in the duct 42. The valve 44 carries a sealing ring 46 which is urged into engagement with a tapering portion of the duct 42 by a spring 48.

The body portion 2 has an arm 50 which couples the pump section 4 to the valve section 6. The arm defines a channel 52 which extends from the upper end of the chamber defined by the wall 36 to an outlet spout 54.

A downstream valve 56 is located in the channel 52 and is biassed by a spring 58 to close the channel. The valve 56 carries an annular sealing member 57 which is arranged to engage a valve seat within the channel 52. The valve portion 6 carries a pillar 66 which pivotally supports a lever 62. The left hand end of the lever 62 defines an actuating arm while the right hand end of the lever 62 is coupled to the valve 56 by a head 68 which is in screw-threaded engagement with the valve 56. A stop 70 which is screw-threadedly coupled to the arm portion 6 provides an abutment surface for the spring 58.

Figure 4:
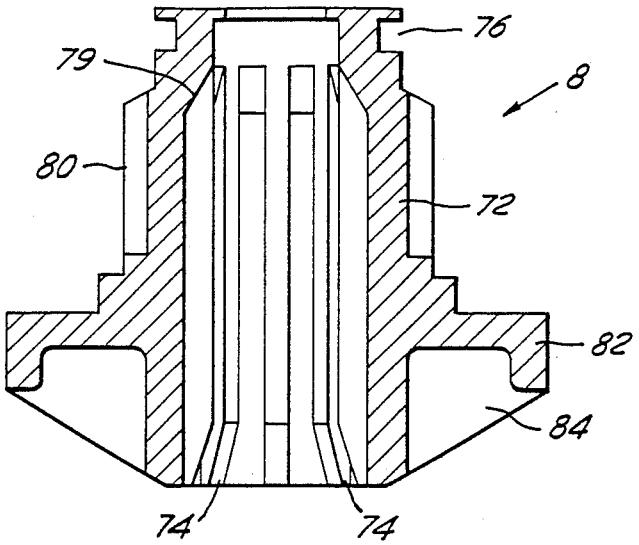
FIG. 4 is a longitudinal section through a fastening member of the apparatus of FIG. 1.
Figure 5:
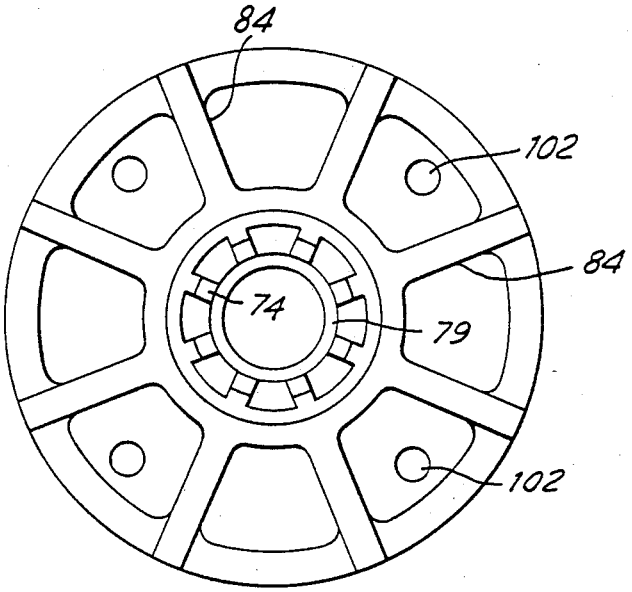
FIG. 5 is an underplan view of the fastening member of FIG. 4.

The fastening member 8 (also shown in FIGS. 4 and 5) has a hollow body portion 72 with an inner surface or bore defining a plurality of spaced auxiliary extending ribs 74. The upper end of the bore has a tapered section 79. When the pipe 14 is forced into the bore it will be gripped by the ribs 74 and its upper end will make a seal with the tapered setion 79.

At its upper end the body portion 72 defines a circumferential groove 76 for receiving a ring seal 78. An intermediate section 80 of the body portion 72 is screw-threaded for screw-threaded engagement with a complementary screw-thread the inner surface of the wall 36. When the fastening member 8 is in screw-threaded engagement with the body portion 2, the seal 78 ensures that a fluid tight seal is effected between the channel 52 and the pipe 14.

The lower end of the body portion 72 carries a retaining flange 82. The retaining flange 82 is supported by a plurality of equiangularly spaced bracing ribs 84.

The retaining flange 82 imprisons the locking ring retainer 10 and the locking ring 12 to the body portion 2. The locking ring 12 is allowed to rotate freely relative to the fastening member 8.

Figure 2:
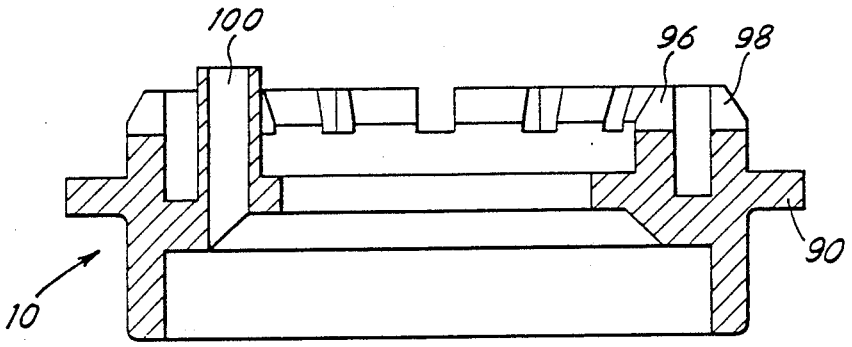
FIG. 2 is a longitudinal section through a locking ring retainer of the apparatus.
Figure 3:
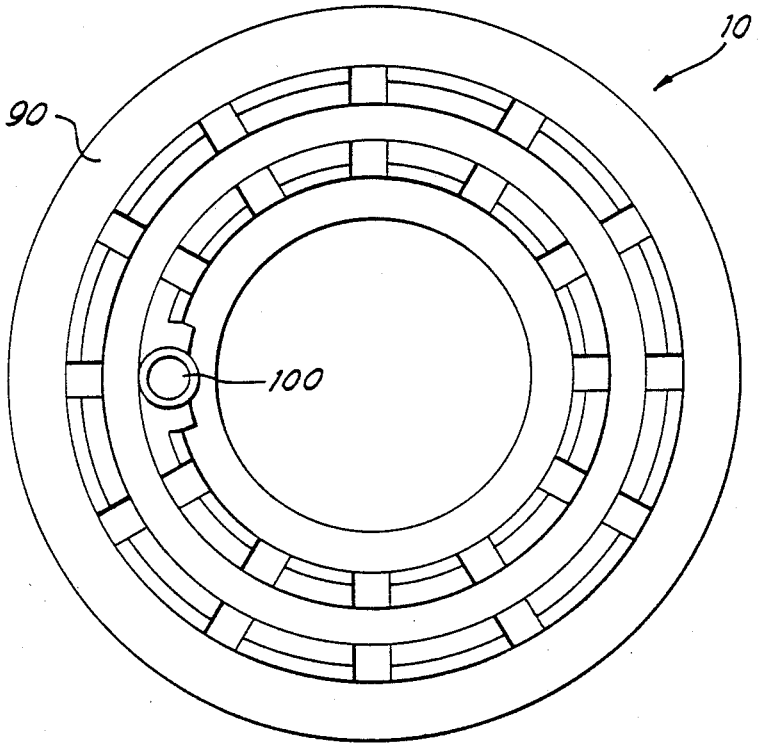
FIG. 3 is a plan view of the retainer of FIG. 2.

The locking ring retainer 10 (see also FIGS. 2 and 3) comprises an annular member having a central flange 90 arranged to abut the retaining ring 12 with its upper surface and engages an annular seal 92 on its under surface.

An annular wall 94 on the underside of the flange 90 is arranged to accommodate the retaining flange 82 of the fastening member 8.

A pair of concentric walls 96 and 98 on the upper surface of the flange 90 define an annular channel for receiving a ring seal 91 and the wall 38 depending downwardly from the body portion 2. The walls 96 and 98 are periodically interrupted to accommodate and bracing ribs (not shown) bracing the walls 36 and 38.

Mounted in the wall 96 is a hollow tube 100 to matingly engage the duct 42 and so convey air from the duct to the chamber defined by the wall 94 on the underside of the flange 90. The flange 82 is likewise provided with a plurality of equiangularly spaced holes 102 to allow air to pass from the chamber to the underside of the fastening member 8.

The locking ring 12 is internally screw-threaded to screw-threadedly engage the neck portion 11 of the container 13.

The ring 12 has an inwardly extending annular flange 120 which is arranged to engage the flange 90 and cause the flange 90 to compress the seal 92 against the upper rim of the neck 11 to seal the apparatus to the container 13.

In operation with the apparatus sealed to the container 13, the piston member 22 is raised and lowered several times to pump air into the container 13.

The forward stroke is performed by moving the piston member 22 from the raised to the lowered position and during this stroke the seal 32 engages the sides of the cylinder and forces the air below through the duct 42. The seal 46 of the non-return valve is moved away from the tapered portion of the duct and the air passes through the tube 100 of the locking ring retainer 10 and then through the openings 102 of the fastening member 8 into the container 13.

On the return stroke of the piston member 22, the seal 46 of the valve 44 closes against the tapered portion of the duct to prevent the escape of air from the container and the piston seal is allowed to move away from the side of the cylinder to admit a fresh intake of air. At the end of the return stroke the cylinder is again full of air and ready for the next forward stroke. After reciprocating the piston member 22 a number of times, sufficient pressure will be built up in the cylinder.

To dispense fluid from the cylinder 13 the arm of the lever 62 is pivoted to open the valve member 56. The liquid under pressure in the container 13 will be forced up the pipe 14 through the channel 52 to pass the open valve 56 and discharge through the outlet spout 54. Upon releasing the lever 62 the spring 58 will close the valve 56 and the flow of liquid from the spout 54 will cease.

While a presently preferred embodiment of the present invention has been illustrated and described, modifications and variations thereof will be apparent to those skilled in the art given the teachings herein, and it is intended that all such modifications and variations be encompassed within the scope of the appended claim.

I claim:

1. Apparatus for dispensing liquids from a container through an opening defined by the container, the apparatus comprising:

a body portion, a pump assembly for pumping air, supported on the body portion, a valve portion having an outlet duct supported on the body portion, a valve housed in said valve portion for opening and closing the duct, a locking member for locking the body portion on to the opening of said container, a locking member retainer rotatably supporting the locking member, a fastening member defining a liquid flow passage, the fastening member being arranged to be fastened to the body portion, to sealingly couple the liquid flow passage to the outlet duct and to lock the locking member retainer to the body portion, the fastening member and the locking member retainer when locked to the body portion defining an uninterrupted fluid passage from the pump assembly which does not directly communicate with the liquid flow passage, and sealing means located on the locking member retainer for enabling a seal to be effected between the container and the locking member retainer when the locking member retained by the locking member retainer is locked to the container.

2. Apparatus according to claim 1 wherein the body portion defines a cylindrical chamber communicating with the duct and wherein said fastening member is cylindrical and screw-threadedly engages the said cylindrical chamber of the body portion.

3. Apparatus according to claim 2 wherein the fastening member inlcudes an annular seal providing a seal between the fastening member and the chamber.

4. Apparatus according to claim 1 wherein said body portion defines a first cylindrical chamber communicating with the duct and a second annular chamber communicating with the pump assembly and being coaxial with the first chamber, said locking member retainer supporting an annular seal to effect a seal between the outer wall of the second annular chamber and the retainer, the uninterrupted fluid passage being located within the boundary defined by said annular seal.

5. Apparatus according to claim 4 wherein the first and second chambers are braced by bracing ribs.

6. Apparatus according to claim 1 wherein said pump assembly comprises a piston and cylinder assembly for pumping air into said uninterrupted passage.

7. Apparatus according to claim 5 including a non-return valve for allowing air flow through said uninterrupted passage in one direction only.

8. Apparatus according to claim 1 wherein the neck of said container includes an external screw-thread and wherein said locking member is ring-shaped and includes an internal screw-thread for screw-threadedly engaging the external screw-thread on the neck of the container, to lock the apparatus to the container.

9. Apparatus according to claim 8 wherein the valve for opening and closing the duct includes a valve member urged into a valve seat in said duct by biassing means to act against the pressure of fluid in said duct.

10. Apparatus according to claim 9 including lever means operable to open said valve against the force of said biassing means.

11. Fluid dispensing apparatus for coupling to a container having a screw threaded neck, said apparatus comprising:

a pump assembly, a valve assembly, a body portion supporting the pump assembly and the valve assembly, a closure member having an internal screw-thread for screw-threadedly engaging the screw-threaded neck of said container, a retaining member for retaining the closure member on the body portion but which allows the closure member to rotate relative to the body portion, the retaining member defining a central opening, and fastening member accommodated in the central opening, the fastening member acting both to lock the retaining member to the body portion and to couple with a duct in the body portion leading to the valve assembly, the retaining member also defining a separate passage which provides communication from the pump assembly to the container when the apparatus is secured thereto by the closure member.

12. Apparatus according to claim 11 wherein the fastening member defines a central aperture, and a pipe accommodated in the aperture and extending to the bottom of the container when the apparatus is coupled thereto, the fastening member providing communication between the pipe and the duct.

* * * * *